United States Patent [19]

Tsunakawa et al.

[11] Patent Number: 5,014,657

[45] Date of Patent: May 14, 1991

[54] RECOIL STARTER

[75] Inventors: Isao Tsunakawa; Nobuyoshi Rikihisa; Kiyohiko Kato, all of Saitama, Japan

[73] Assignee: Showakiki Industry Co., Ltd., Saitama, Japan

[21] Appl. No.: 496,200

[22] Filed: Mar. 19, 1990

[30] Foreign Application Priority Data

Mar. 24, 1989 [JP] Japan ..... 1-32688
Jan. 30, 1990 [JP] Japan ..... 2-7160

[51] Int. Cl.[5] ..... F02N 3/02
[52] U.S. Cl. ..... 123/185 B
[58] Field of Search ..... 123/185 B, 185 BA, 185 A

[56] References Cited

U.S. PATENT DOCUMENTS 1,162,410 11/1915 Sieverkropp ..... 123/185 A
2,926,648 3/1960 Hamman ..... 123/185 BA
4,492,190 1/1985 Greenwood et al. ..... 123/185 BA
4,970,998 11/1990 Tyler ..... 123/185 B

*Primary Examiner*—Andrew M. Dolinar
*Attorney, Agent, or Firm*—Wenderoth, Lind & Ponack

[57] ABSTRACT

A recoil starter for starting a small-size engine including a starter case, a center shaft, a reel, a rope groove, a rope, a recoil spring, and a dog. In the recoil starter, a circular boss portion is provided on and projected from the central portion of the reel, an engaging opening of a crank pulley is disposed outside the boss portion, an engaging wall having a flat engaging surface is provided on the reel disposed outside the crank pulley. When the dog is engaged with the crank pulley, the leading of the dog is projected externally of the engaging opening to come into engagement with the engaging wall, so that one end of the dog is supported by the engaging wall while the other end thereof is supported by the inner surface of a dog storage hole.

10 Claims, 8 Drawing Sheets

RECOIL STARTER

BACKGROUND OF THE INVENTION

1. Field of the Invention

This invention relates to a recoil starter for starting a small-size engine and, in particular, to such recoil starter which is capable of surely engaging a dog with a crank pulley, of easing the strength required for these components, and of surely preventing a rope from getting out of place.

2. Description of the Prior Art

A recoil starter frequently used for starting a small-size engine, in general, includes a starter case, a reel supported rotatably within the starter case and having a rope groove formed in the peripheral surface thereof in which a rope can be wound, a dog mounted to be rotatable simultaneously with the reel and, when the reel is acceleration rotated, projectable externally in the radial direction to come into engagement with a crank pulley connected with the engine to thereby rotate the pulley, a recoil spring for energizing the reel in the winding direction thereof, and a handle disposed at a pulling side end portion of the rope.

Such recoil starter includes an engaging means for engaging the dog with the crank pulley. As the engaging means, there are conventionally known two types of devices: one of them is a device which engages the dog with an open window formed in the crank pulley, as disclosed in Japanese Utility Model Publication (Jikkai) No. 54-106433; and the other is a device which engages the dog with a convex-shaped step portion formed in the inner peripheral surface of the crank pulley, as disclosed in Japanese Utility Model Publication (Jikkai) No. 56-17370.

With these conventional engaging devices, the dog can be surely engaged with the crank pulley. However, for example, in the case of the former device, since a torsional force and the like is applied to the dog and a reel which supports the dog, the components concerned must be increased in strength. For instance, the dog must be constructed to be thick and also the surface of the dog must be hardened, or the reel must be constructed to be thick and also the crank pully must be quenched.

Also, in the case of the latter device, although the components concerned do not require such great strength as in the former engaging device, the hardening treatment of the dog surface and the above-mentioned thermal treatment of the crack pulley are still required. Further, in engaging the dog with the crank pulley, the dog may slide along on the inner peripheral surface of the crank pulley, resulting in poor engagement.

On the other hand, there is the possibility that the rope of the recoil starter may slip off from the rope groove according to the timing for pulling back the rope into the rope groove in the reel after the starting operation.

For these reasons, conventionally, for example, as disclosed in Japanese Utility Model (Jikkai) No. 61-76167, a substantially dish-shaped rope cover is mounted by spot welding to the inside of the starter case and the peripheral wall thereof is disposed adjacent to the outside of the rope groove so as to prevent the occurrence of the above-mentioned problems.

However, in the last-mentioned conventional rope cover, due to the fact that a notch must be formed in the rope pull-out portion thereof, there arises another possibility that the rope may slip off in the rope pull-out portion. Also, the mounting of the rope cover requires spot welding as well as forming and machining, which takes much time and labor. Further, the yield of the material used is poor and the productivity of the rope cover is low.

SUMMARY OF THE INVENTION

The present invention aims at eliminating the drawbacks found in the above-mentioned prior art devices.

Accordingly, it is an object of the invention to provide a recoil starter having a structure capable of surely engaging a dog with a crank pulley, of enhancing the starting characteristic of an engine, and of reducing loads applied to the dog and crank pulley when engaged.

It is another object of the invention to provide a recoil starter including a rope cover which is capable of surely preventing a rope from getting out of place and also which can be manufactured with ease and at a low cost.

It is still another object of the invention to provide a recoil starter which can be rationalized in manufacture and also can be reduced in weight.

In order to achieve the above objects, according to the invention, there is provided a recoil starter for starting a small-size engine including a starter case, a center shaft, a reel, and a rope groove, a recoil spring and a dog, characterized in that a circular projecting boss portion is provided in the central portion of the reel, an engaging opening of the crank pulley is positioned in the outside of the boss portion, an engaging wall having a flat engaging surface is projectingly provided on the reel disposed outside of the crank pulley, and, when the dog and crank pulley are engaged with each other, the leading end of the dog is projected externally of the engaging opening and is thereby engaged with the engaging wall so as to support one end of the dog by the engaging wall as well as support the other end of the dog by the inner surface of a dog storage hole.

The above-mentioned and other objects, characteristics and advantages of the present invention will be more obvious from reading of the following detailed description in connection with the accompanying drawings.

DETAILED DESCRIPTION OF THE PREFERRED EMBODIMENTS

Figure 1:
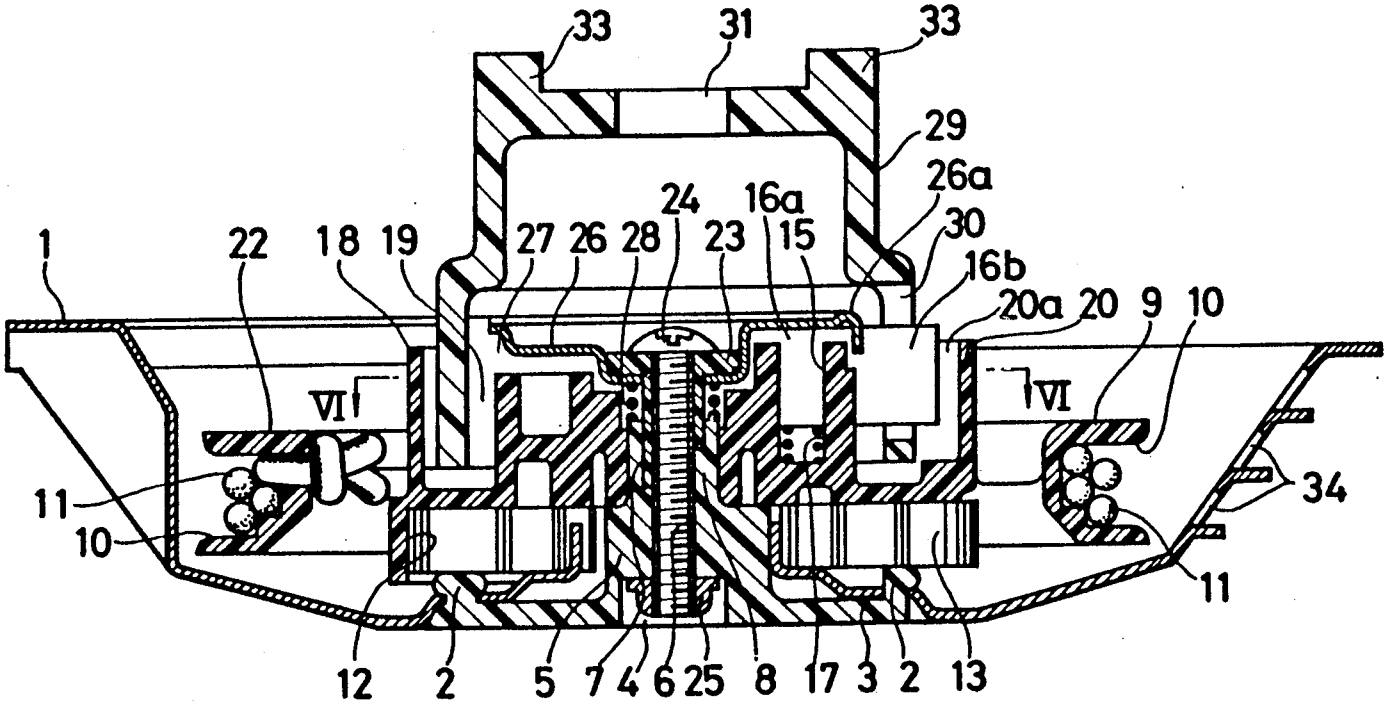
FIG. 1 is a section view of a preferred embodiment according to the invention.

At first, description will be given below in detail of a preferred embodiment according to the present invention in connection with FIGS. 1 through 8. In these figures, reference numeral 1 designates a substantially dish-shaped starter case which is formed of metal or synthetic resin. To the bottom surface of the starter case 1 is mounted via pins 2 a center cover 3 formed of synthetic resin.

A concave-shaped hole 4 is opened up in the central portion of the cover 3, a stepped center shaft 5 is projectingly provided inside of the cover 3, and inside of the center shaft 5 there is formed a through-bore 6 in communication with the above-mentioned concave-shaped hole 4. At one end of the through-bore 6 there is formed a concave-shaped portion 7 having a slightly larger diameter and on the inner peripheral surface of the concave-shaped portion 7 there are provided a pair of longitudinally elongated engaging projections 8.

On the end side of the above-mentioned center shaft 5 is rotatably supported a reel 9 formed of synthetic resin, and in the side peripheral surface of the reel 9 there is formed a rope groove 10 into which a rope 11 can be wound. Also, a spring chamber 12 is formed on one side of the reel 9 and a recoil spring is stored within the spring chamber 12. The restoring force of the recoil spring energizes the reel 9 in its winding direction.

Centrally of the reel 9 there is projected a circular boss portion 9*a* and in the central portion of this boss portion 9*a* there is formed a shaft insertion hole 14 into which the center shaft 5 can be fitted. Outside of the hole 14 there are formed a pair of dog storage holes 15 in each of which a pivotally supporting of a dog 16 is stored in a rotatable manner. Also, a dog spring 17 is accomodated in the bottom portion of the hole 15.

Figure 5:
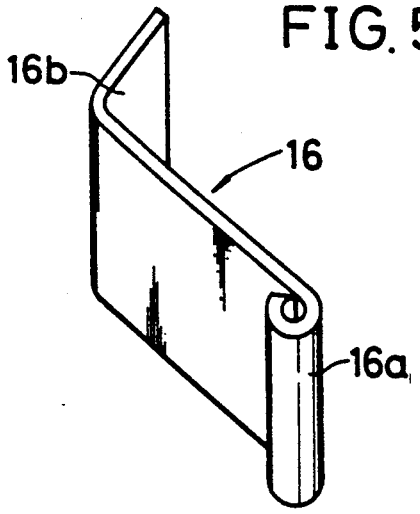
FIG. 5 is a perspective view of a dog employed in the invention.

The above-mentioned dog 16 can be constructed, for example, by bending a relatively thicker steel plate into a substantially L-shaped member. Such dog 16, as shown in FIG. 5, includes a pivotally supporting portion 6*a*, which is formed by winding the edge portion of the steel plate into a cylindrical shape, and a flat-plate-shaped bent portion 16*b* which is formed by gently bending the other edge portion of the steel plate. With no surface hardening treatment as in the prior art, the dog 16 can be used as it is, and further one end of the dog spring 17 can be hitched round the side edge of the middle portion of the dog 16 to thereby energize the bent portion 16*b* in a direction toward the center of the reel 9.

On the other hand, outside of the boss portion 9*a* there is projected an annular wall 18 which is concentric with the boss portion 9*a*. The projecting height of the annular wall 18, as shown in the drawings, is substantially level with the opening edge of the dog storage hole 15 and an annular groove 19 is formed between the annular wall and the outer peripheral wall of the boss portion 9*a*.

Figure 2:
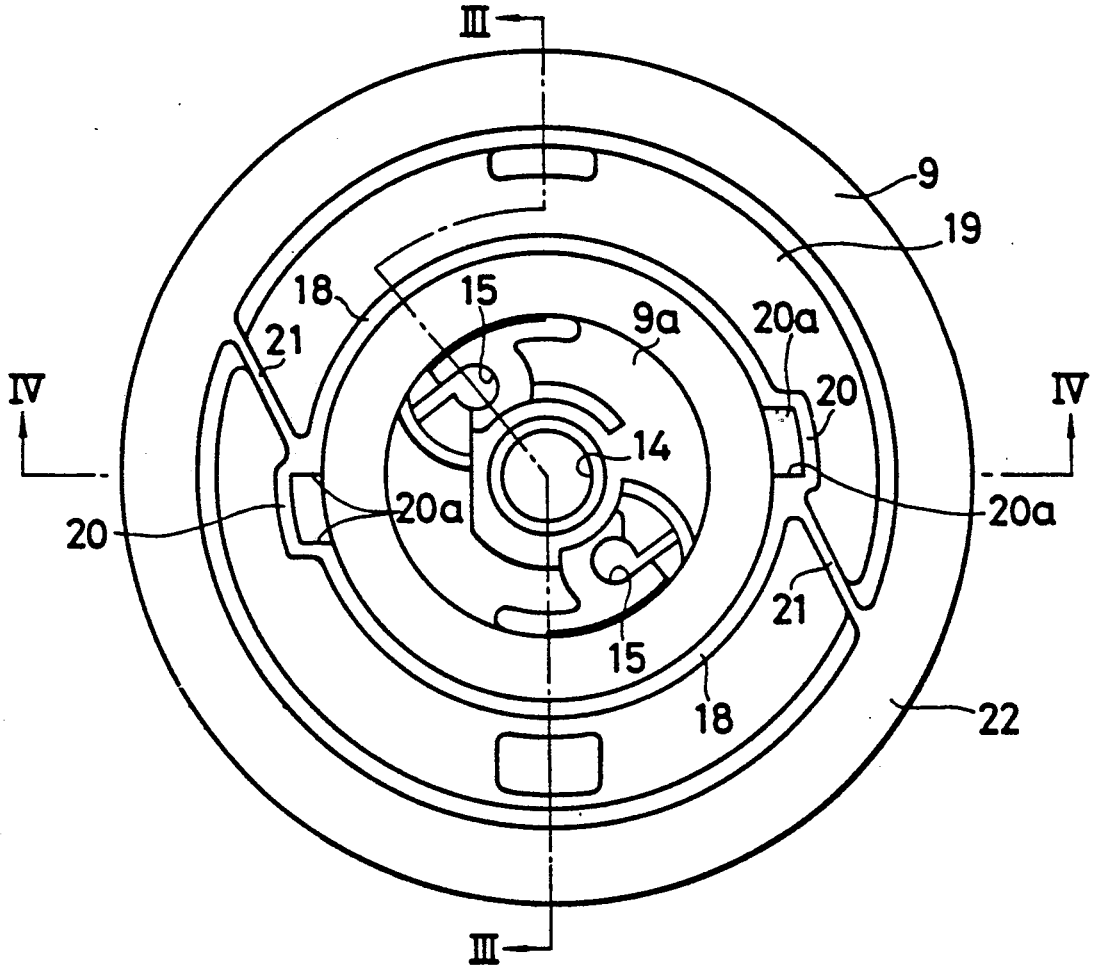
FIG. 2 is a plan view of a reel employed in the invention.
Figure 3:
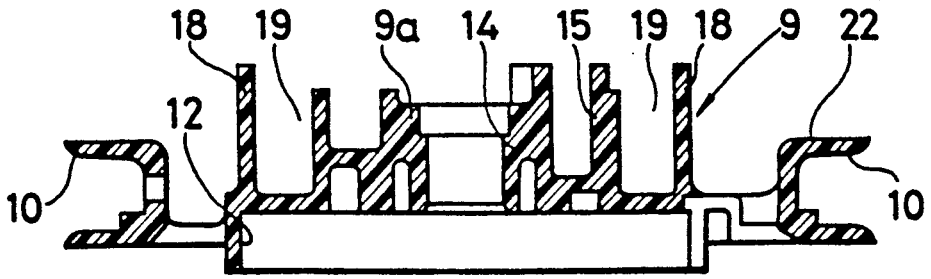
FIG. 3 is a section view taken along the line III—III in FIG. 2.
Figure 4:
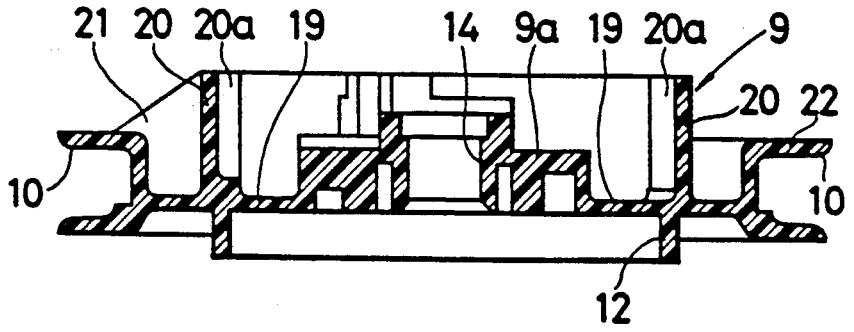
FIG. 4 is a section view taken along the line IV—IV in FIG. 2.

At the opposed positions of the above-mentioned annular wall 18, there are provided a pair of projecting walls 20 which are respectively projected externally of the annular wall 18 and each of the projecting walls 20, as shown in FIG. 2, is formed in a substantially U-shaped configuration. Also, at the two ends thereof extending along the circumferential direction thereof, the projecting wall 20 has two engaging walls 20*a*, 20*a* which are engageable with the bent portion 16*b* of the above-mentioned dog 16. The inner peripheral surfaces of the engaging walls 20*a*, 20*a*, that is, the engaging surfaces of the walls 20*a*, 20*a* with the bent portion 16*b* are formed in a flat surface and thus these flat surfaces form parallel planes extending toward the center of rotation of the reel 9.

In this case, the annular wall may be omitted and only the projecting walls 20 may be provided. Further, only the engaging wall 20*a*, which is part of the projecting wall 20, may be provided. In the last-mentioned case, the number of the engaging walls 20*a* may not be two, but may be the same with the number of the dogs 16.

In the drawings, numeral 21 designates reinforcing walls interposed between the projecting walls 20, 20 and a peripheral groove flange 22 which is provided with a rope groove 10 in the inner peripheral surface thereof, and the annular groove 19 is divided into two sections by means of these reinforcing walls 21, 21. 23 designates a collar one end of which is inserted into a concave-shaped portion 7. The collar 23 includes in the shaft end thereof a slit (not shown) into which the engaging projection 8 can be fitted, thereby preventing the rotation thereof within the concave-shaped portion 7.

Numeral 24 designates a center screw which is inserted into the above-mentioned collar 23 and into the through-bore 6 and the center screw 24 has a threaded shaft end threadedly engaged with and tightly fastened by a nut 25 which is provided within the concave-shaped hole 4. And, 26 stands for a substantially dish-shaped retainer which includes a flange portion 26*a* in the peripheral edge thereof. The retainer 26 also is formed at the opposed position thereof to the flange portion 26*a* a notch 27 having a suitable width into which the dog 16, so that the dog 16 can put into and taken out from the notch 27. 28 designates a friction spring which is mounted to the outer peripheral surface of the collar 23.

Also, 29 stands for a crank pulley which is formed of synthetic resin in a cylindrical shape having a stepped portion. On the peripheral surface of the larger-diameter side of the crank pulley 29, there are formed a pair of engaging openings 30 which are engageable with the bent portion 16b of the dog 16. When the crank pulley 29 is assembled, the larger-diameter side peripheral surface, as shown in FIG. 1, is positioned within the annular groove 19 to thereby prevent the open air from flowing into around the boss portion 9a and into the crank pulley 29, so that these parts can be protected against dust.

Numeral 31 designates a crankshaft insertion hole which is formed at the axially central position of the crank pulley 29, 32 a rope engaging hole for emergency which is opened up in the opening edge of the pulley 29, 33 an engaging projection for positioning which is provided on and from the end face of the crank pulley 29, and 34 an ventilation port which is formed in the starter case 1.

Figure 9:
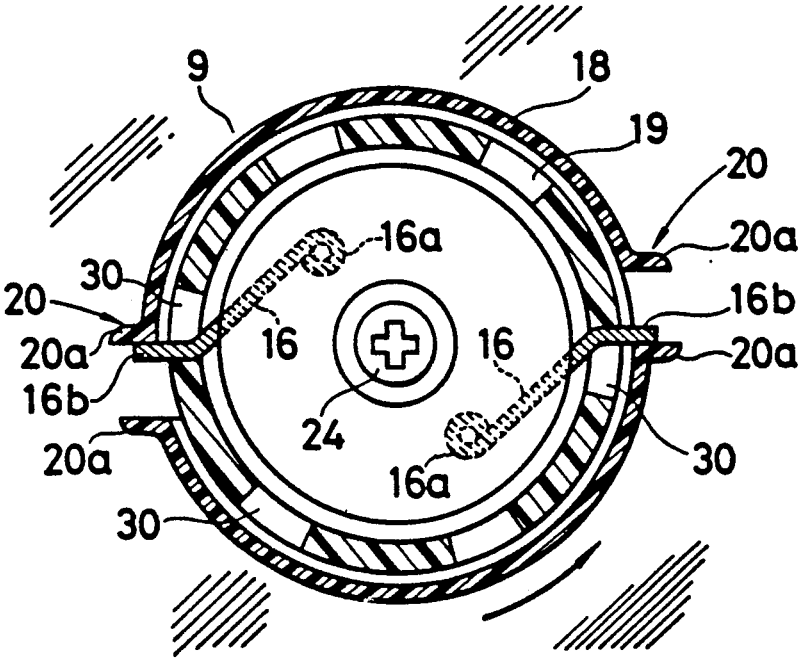
FIG. 9 is a transverse sectional view of the main portions of another embodiment according to the invention.

Referring now to FIG. 9, there is shown a transverse sectional view of main portions of another embodiment according to the invention, in which parts corresponding to those in the above-mentioned embodiment are given the same designations. In other words, this second embodiment is characterized in that the outer end portions of projecting walls 20, 20 are cut away but only a pair of engaging walls 20a, 20a are projectingly provided to thereby be able to secure a desired engaging effect and thus provide a simplified structure. In this embodiment, similarly to the first embodiment, the annular groove 18 and one of the engaging walls 20a can be omitted.

In the recoil starter constructed in this manner, as will be discussed later, the portions thereof around the dog storage hole 15 need not be specially thick when producing the reel 9, and the dog 16 can be produced by press forming a thin steel plate or the like into a substantially L-shaped configuration while one end of the dog 16 is then curling formed to thereby provide the pivotally supporting portion 16a thereof, thereafter requiring no surface hardening treatment.

Therefore, the above-mentioned parts used in this embodiment can be manufactured with more ease and at a lower cost when compared with the conventional parts of this type.

Also, due to the fact that the crank pulley 29 may be integrally formed of synthetic resin, the crank pulley 29 in this embodiment of the invention is easier to machine, can be manufactured at a lower cost and is lighter in weight over the conventional crank pulley that is formed of metal or formed of aluminum by die casting.

In this manner, in this embodiment according to the invention, the reel 9, dog 16 and crank pulley 29 do not require any special strength.

The various components manufactured in the above-mentioned manner, similarly to the conventional components, are assembled together to set up the recoil starter and, with the retainer 26 side of the recoil starter opposed to the crank pulley 29 previously fixed to a predetermined position, the starter case 1 is then screwed to a fan case (not shown). FIG. 1 shows such assembling.

In other words, in such assembly, the larger-diameter portion of the crack pulley 29 is situated within the annular groove 19 and the peripheral wall of the pulley 29 and the annular wall 18 form an inner/outer dual wall to prevent the air from flowing into the portions around the boss portion 9a and into the crank pulley 29, so that a dust-proof structure with respect to these components is formed.

Also, in this case, the bent portion 16b of the dog 16 is pulled internally of the reel 9 by the dog spring 17 so that the dog bent portion 16b is situated on the peripheral surface of the retainer 26, that is, inside of the flange portion 26a.

Figure 6:
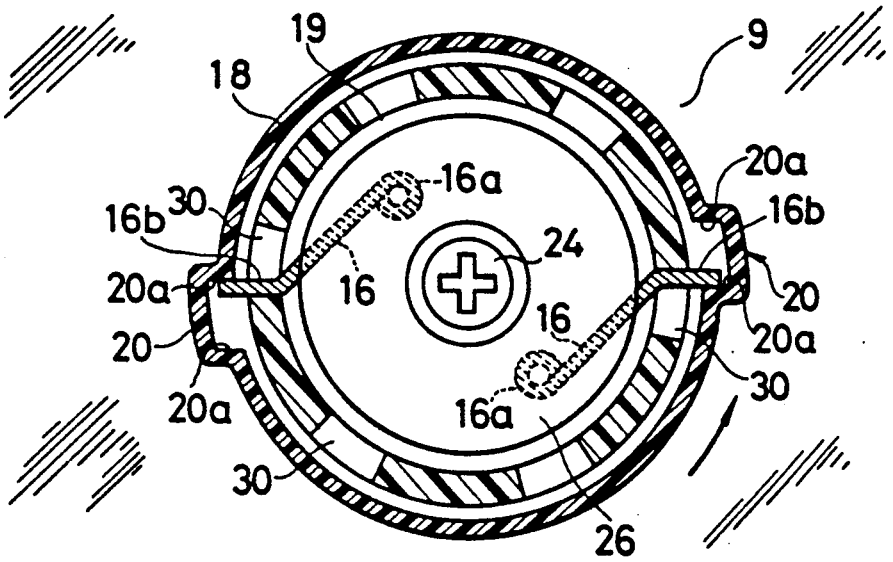
FIG. 6 is a transverse sectional view taken along the VI—VI in FIG. 1, illustrating in part the embodiment for the purpose of explanation.
Figure 7:
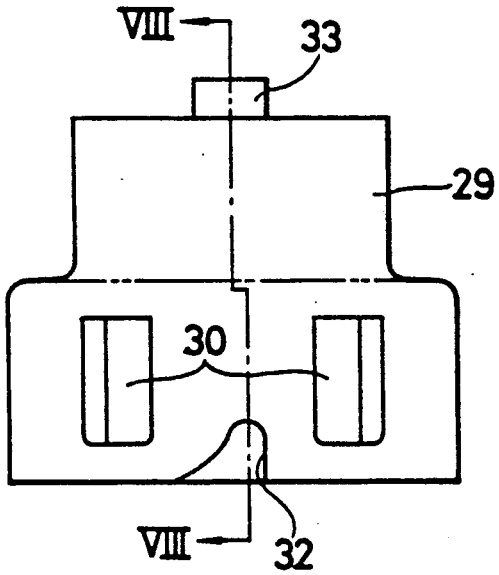
FIG. 7 is a front view of a crank pulley employed in the invention.
Figure 8:
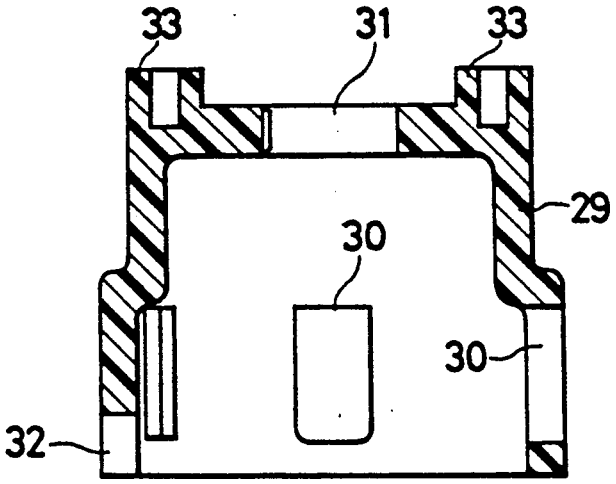
FIG. 8 is a section view taken along the line VIII—VIII in FIG. 7.

Under such condition, if the rope 11 is pulled to start the recoil starter, then the reel 9 is rotated in a direction of an arrow in FIG. 6 so that the dogs 16, 16 to be moved simultaneously with the reel 9 is caused to project externally in the radial direction against the dog springs 17, 17. As a result of this, the bent portions 16b, 16b of the dogs 16, 16 are inserted into the engaging openings 30, 30 of the crank pulley 29 from inside thereof and are then engaged with the opening end faces thereof, whereby the torque on the side of the recoil starter is transmitted to the crank pulley 29 to start an engine (not shown).

In this case, since the above-mentioned torque transmission is carried out by means of engagement of the bent portion 16b with the engaging opening 30 of the crank pulley 29, a reliable torque transmission can be obtained, resulting in an excellent engine startability.

Also, due to the fact that the bent portion 16b is engaged with the engaging surface of the engaging opening 30 in a surface-to-surface contact manner and thus the starting loads of the crank pulley 29 are received with the entire contact surface of the bent portion 16b, a surface pressure in such contact portion is very small. This is the reason why the crank pulley 29 can be formed of synthetic resin instead of metal which is used in the prior art.

Further, when the bent portion 16b is engaged with the engaging opening 30, the leading end portion of the bent portion 16b is projected externally of the crank pulley 29 and, as shown in FIG. 6, it is then engaged with the engaging wall 20a of the projecting wall 20 prvided on and projected from the reel 9. Thus, due to the fact that the dog 16 is engaged with the engaging opening 30 in such a manner that the two ends thereof are supported with the inner surface of the dog storage hole 15 as the base end thereof, the support strength of the dog 16 is increased over a conventional dog which is supported in a cantilever manner, so that the dog 16 has a sufficient stregth to resist the torsional force and bending moment that are applied onto the dog 16 when the crank pulley 29 gives its starting loads.

Therefore, the dog 16 can be formed of a thin steel plate and requires no surface hardening treatment before it is used. Also, since the reaction on the pivotally supporting portion 16a side of the dog 16 can be reduced, the portions around the dog storage hole 15 can be structured to be thinner than the conventional ones. Further, in the above-mentioned case, the peripheral wall portions of the projecting walls 20, 20, which are located in the outer ends of the walls 20, 20, prevent displacement of the engaging walls 20a, 20a and also increase the strength of the engaging walls 20a, 20a.

When the engine is started in this manner, then the speed of rotation of the crank pulley 29 is increased gradually and exceeds the speed of rotation of the reel 9. If the speed of rotation of the crank pulley 29 exceeds the speed of rotation of the reel 9, then there is generated a speed difference between the crank pulley 29 and dog 16, which urges the dog 16 to return to its initial position. In its return process, the back surface of the bent portion 16b of the dog 16 comes in contact with and is struck by the edge portion of the engaging opening 30.

However, even in this case, since the crank pulley 29 is formed of synthetic resin, it does not make such an unpleasant metallic sound as in the conventional one.

On the other hand, before or after the returning operation of the dog 16, a rope handle (not shown) is released off from an operator's hand after the starting of the engine and, as a result of this, the reel 9 is rotated in a reversed direction due to the restoring force of the recoil spring 13, so that the dogs 16, 16 are caused to return to their respective initial positions.

Next, description will be given below of a recoil starter including a rope cover which is another characteristic of the invention by way of a preferred embodiment shown in FIGS. 10 through 15. In the drawings, the components that correspond to those in the above-mentioned embodiments are given the same designations.

Now, outside of the reel 9, there is disposed a rope cover 35 formed of synthetic resin. The rope cover 35, as shown in the drawings, is formed in a ring shape and the periphery of the rope cover 35 is divided by a peripheral wall 35*a* having a larger width than the groove width of the rope groove 10. The peripheral wall 35*a* is disposed adjacent to the opening of the rope groove 10. The peripheral wall 35*a* also includes in the end edges thereof engaging edges 35*b* which are respectively projected internally and externally, so that the peripheral wall 35*a* can be engaged with the end peripheral surface of the reel 9 or with the starter case 1 by means of the engaging edges 35*b*.

Further, in the peripheral wall 35*a*, there is provided a projecting portion 36 a portion of which is projected externally, and there is formed a transversely elongated, rectangular open window 37 in the projecting portion 36. The open window 37 is positioned inside a rope guide 38 which is mounted to the starter case 1. Moreover, in the upper end portion of the peripheral wall 35*a*, there are provided a plurality of engaging pieces 39 which are projected externally. Each of the engaging pieces 39, in the illustrated embodiment, has a substantially V-shaped engaging recessed portion 40 which is engageable with one of a plurality of projected portions 41 provided on and projected from the inner surface of the starter case 1, whereby the peripheral wall 35*a* is prevented against rotation together with the reel 9.

In addition, in the drawins, numeral 42 designates a recessed portion which is formed in the central portion of the reel and the periphery of the recessed portion 42 is divided by an annular wall 43 which is disposed concentrically with the above-mentioned annular wall 18. To the opening of the recessed portion 42 is mounted the retainer 26 through the center screw 24 and friction spring 28 in such a manner that the retainer 26 is frictionally rotatable. Outside of the annular wall 43, there are formed a pair of dog storage holes 15 in which the pivotally supporting portions 16*a* of the dogs 16 are rotatably stored.

Numeral 44 designates a reinforcing portion formed by forming and machining the bent portion of the dog 16, 45 a dog spring, 46 a ventilation port which is formed in the bottom surface of the starter case 1, and 47 a ventilation port which is formed in the reel 9 and divided by a rib 48.

Referring now to FIGS. 16 through 20, there is shown another embodiment of a rope cover 35, and in these figures the components that correspond to those in the above-mentioned embodiments are given the same designations.

In particular, in this embodiment, the rope cover 35 is not formed in a ring shape from the beginning but instead it is formed in an elongated band shape. Then, in the end portion of the rope cover 35, there are provided a pair of engaging holes 49 and a pair of engaging claws 50 which are engageable with the engaging holes 49. In manufacturing the rope cover 35, the peripheral wall 35*a* is bent into a ring shape, and the engaging claws 50 are engaged with the engaging holes 49 so as to assemble the rope cover 35.

If the rope cover 35 is constructed in this manner, then it is easier to manufacture a metal mold and the rope cover 35 when compared with the above-mentioned embodiment and also the rope cover 35 is not bulky before assembling, which makes it highly convenient to handle the rope cover 35. In the drawings, numerals 51, 52 respectively designate elongaged rectangular engaging pieces which are provided on the upper and lower end portions of the peripheral wall 35*a* and are alternately projected inwardly. The reel 9 is stored between these engaging pieces 51, 52 to thereby make sure the mounting of the reel 9.

Since the thus constructed rope cover 35 is integrally formed of synthetic resin, when compared with a conventional rope cover which is constructed by bending a metal plate, the required time and labor to manufacture it can be reduced to a half, products of uniform quality can be obtained, and there is eliminated a problem involved with the yield of material, which is found in the prior art.

When assembling the rope cover 35 manufactured in the above-mentioned manner, in a case shown in FIGS. 10 to 15, while the engaging piece 39 is faced upward before the reel 9 is assembled, the rope cover 35 is stored within the starter case 1. During such storing operation, the projecting wall 36 is located at a position adjacent to the rope guide 38 and the open window 37 is disposed opposed to the projecting wall 36. Then, under such condition, the engaging recessed portions 40 of the respective engaging pieces 39 are brought into engagement with the projected portions 41 provided within the starter case 1, respectively.

Thanks to this, the mounting position of the rope cover 35 with respect to the starter case 1 can be determined and also their positional relation ship can be kept, so that the rope cover 35 can be mounted in such a manner that it is substantially concentric with the reel 9.

Therefore, after the mounting of the rope cover 35, the reel 9 having the rope 11 wound thereround is fitted into the center shaft 5 and the dogs 16 are then assembled to such reel 9. Then, such reel 9, together with the retainer 26, is mounted to the center shaft 5 via the center screw 24. That is, the assembling manner after the mounting of the rope cover 35 is similar to a conventional manner.

In this case, after the rope cover 35 is assembled, the winding-out side of the rope 11 wound in the rope groove is inserted through the open window 37, is further inserted through the rope guide 38, and then the end thereof is stored in a handle (not shown).

Figure 10:
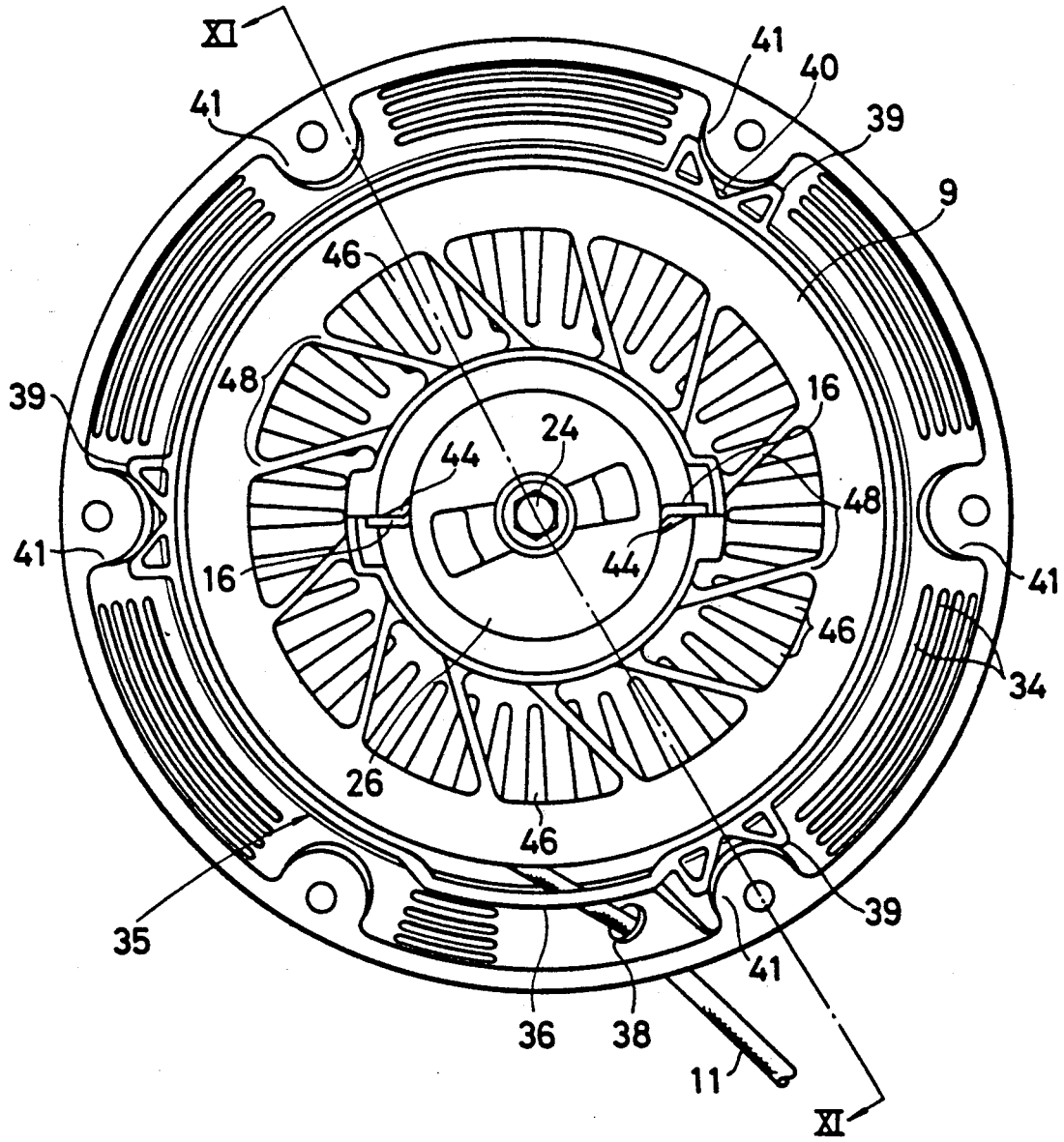
FIG. 10 is a plan view of another embodiment of a recoil starter employed in the invention, illustrating a state in which the recoil starter is assembled.
Figure 11:
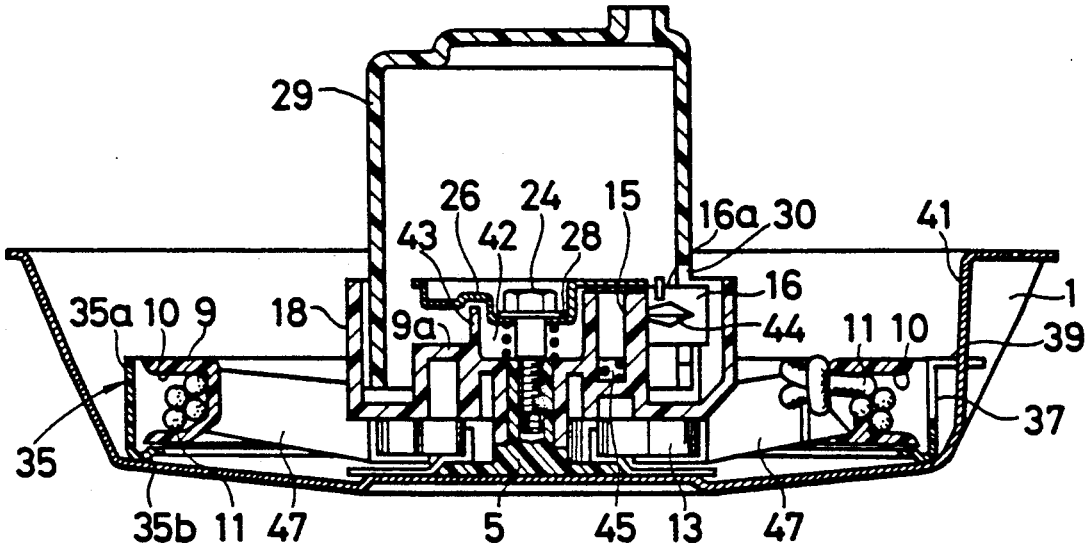
FIG. 11 is a section view taken along the line XI—XI in FIG. 10.
Figure 12:
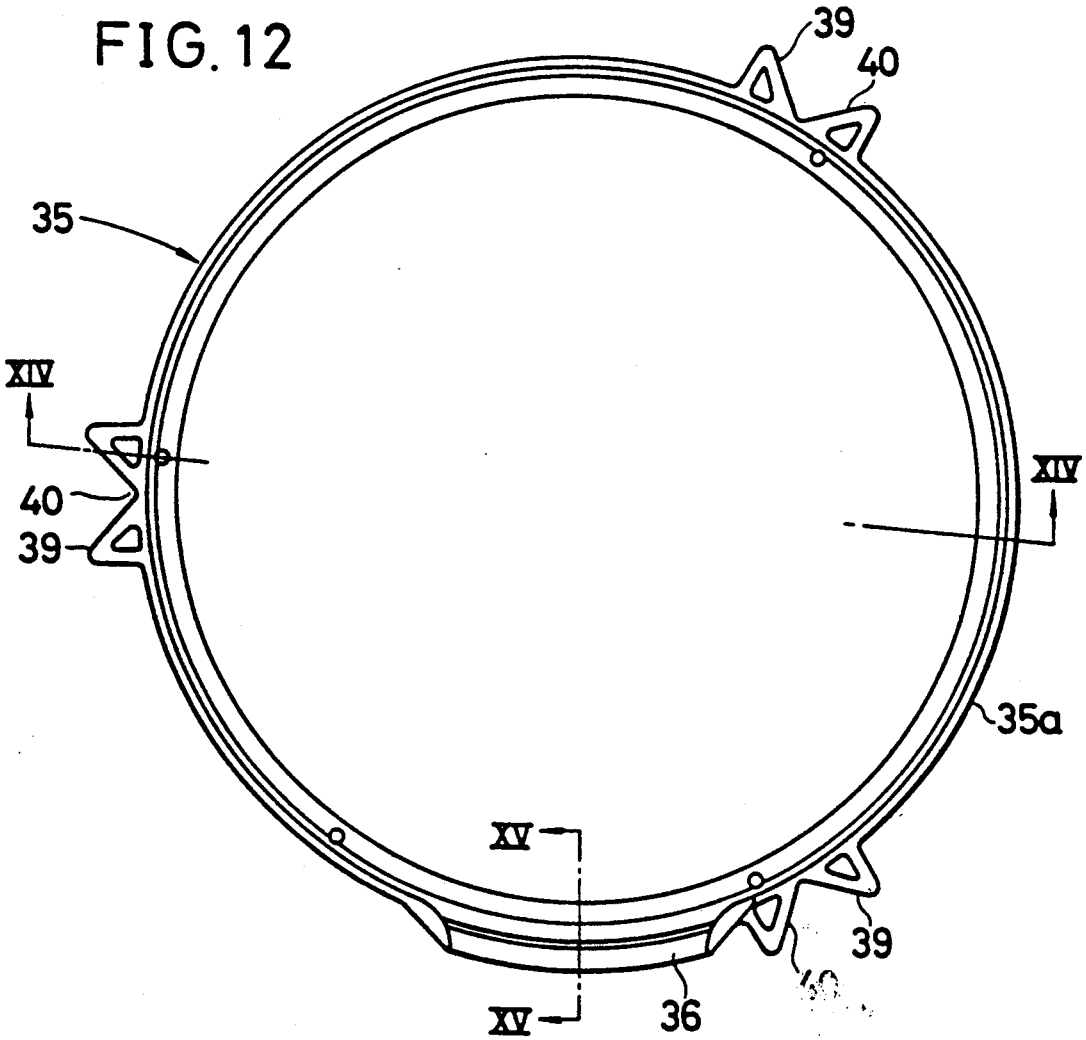
FIG. 12 is a plan view of an embodiment according to invention.
Figure 13:
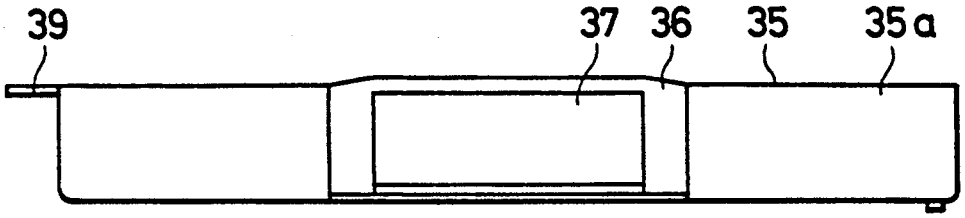
FIG. 13 is a front view of the embodiment shown in FIG. 12.
Figure 14:
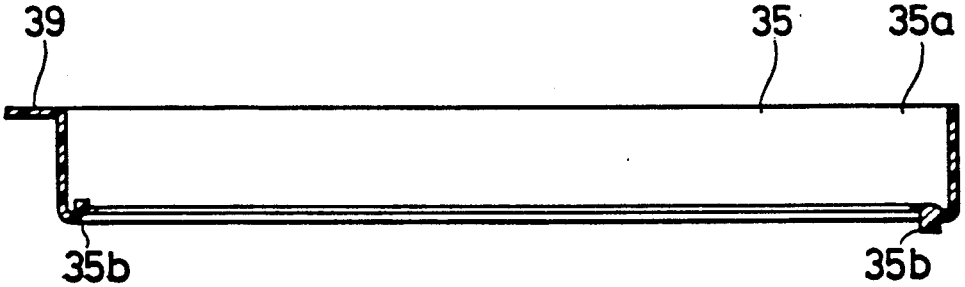
FIG. 14 is a section view taken along the line XIV—XIV in FIG. 12.
Figure 15:
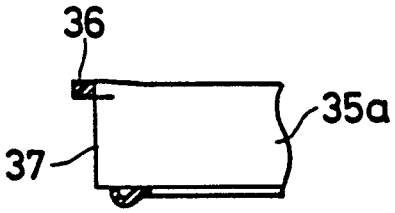
FIG. 15 is a section view taken along the line XV—XV in FIG. 12.
Figure 16:
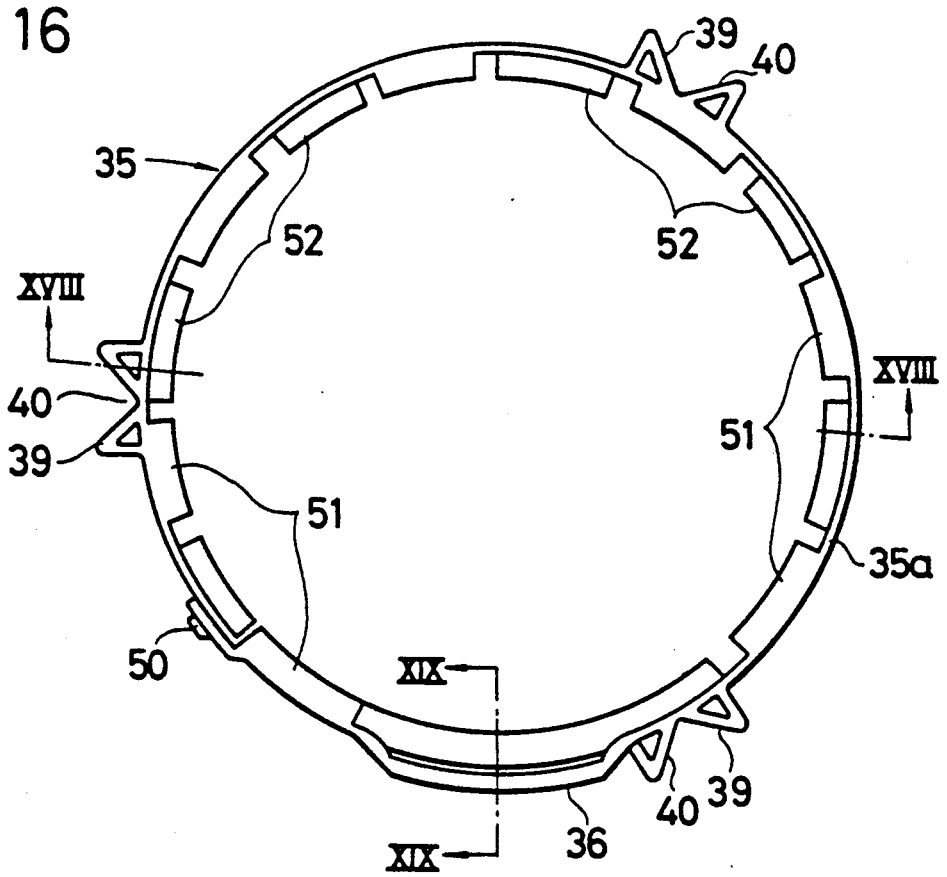
FIG. 16 is a plan view of another embodiment according to the invention.
Figure 17:
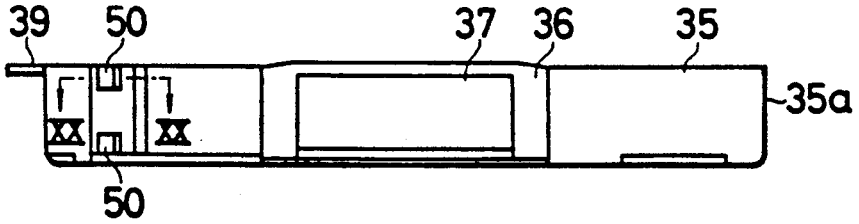
FIG. 17 is a front view of the embodiment shown in FIG. 16.
Figure 18:
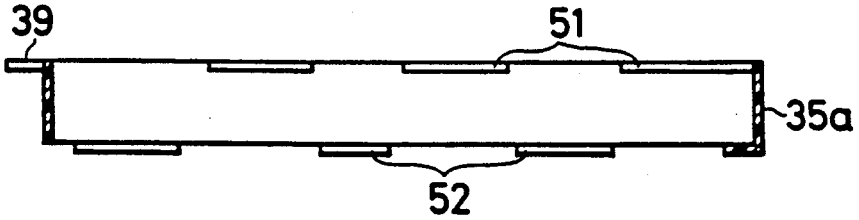
FIG. 18 is a section view taken along the line XVIII—XVIII in FIG. 16.
Figure 19:
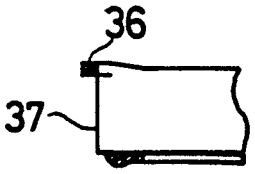
FIG. 19 is a section view taken along the line XIV—XIV in FIG. 16.
Figure 20:
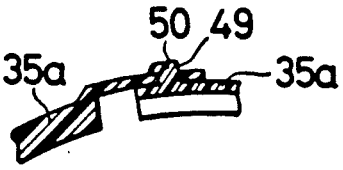
FIG. 20 is a section view taken along the line XX—XX in FIG. 17.

The thus assembled rope cover 35 is placed inside the starter case 1 and the peripheral wall 35*a* is disposed adjancent to the outside of the rope 11. Also, according to the assembled conditions of an engine (not shown) and the recoil starter, the starter case 1 may be placed in the bottom or top, or in its upright state when it is assembled. Correspondingly to this, the engaging edge 35*b* of the rope cover 35 may be disposed in such a manner that it is engageable with the inner surface of the starter case 1 as shown in FIG. 10, or the engaging edge 35*b* may be mounted in such a manner it is in engagement with the peripheral end surface of the reel 9.

In either case, since the engaging recessed portion 40 is in engagement with the engaging projected portion 41 to thereby keep the mounting position of the rope cover 35 with respect to the starter case 1, there is no possibility that the rope cover 35 may be moved out of place due to vibrations or the like. That is, the thus assembled rope cover can stand comparison with one which is constructed integrally with the starter case 1.

Next, when winding back the rope 11 wound out in the starting operation, the rope 11 is wound back through the open window 37 and thus the running condition of the rope 11 can be restricted by means of the open window 37. Therefore, there is eliminated the possibility that the rope may be moved out of place. Also, the peripheral wall 35*a* is positioned adjacent to the rope groove 10 to prevent the rope 11 from getting out of place in the rope groove 10.

In this embodiment, even if the reel 9 is oscillated or gets in direct touch with the rope cover 35 when the rope 11 is wound out or wound back, there is no possibility that the rope cover 35 may be moved together with the reel 9 because the engaging recessed portions 40 formed in the engaging pieces 39 integral with the rope cover 35 are in engagement with the associated projected portions 41 provided in the starter case 1.

Also, since the action force required for the rope 11 to get out of place is at most equal to the returning force of the rope 11, the rope cover 35 formed of synthetic resin arises no problem with strength.

What is claimed is:

1. A recoil starter for starting a small-size engine, comprising:

a starter case 1;

a center shaft 5 provided on and projected from the inside of said case 1;

a reel 9 supported rotatably by said shaft 5;

a rope groove 10 formed in the peripheral surface of said reel 9;

a rope 11 wound in said rope groove 10 with one end thereof being fixed to said reel 9;

a recoil spring 13 for energizing said reel 9 in the winding direction thereof; and, a dog 16 supported pivotably in a dog storage hole 15 formed in said reel 9 and, when an engine starting operation is performed, projectable externally of said reel 9 to come into engagement with an engaging opening 30 formed in a crank pulley 29 connected to said engine to thereby start the rotation of said pulley 29; and wherein;

(a) a circular boss portion 9*a* is provided on and projected from the central portion of said reel 9;

(b) said engaging opening 30 of said crank pulley 29 is disposed outside of said boss portion 9*a*;

(c) an engaging wall 20*a* having a flat engaging surface is provided on and projected from said reel 9 disposed outside of said crank pulley 29;

(d) when said dog 16 is engaged with said crank pulley 29, the leading end of said dog 16 is projected externally of said engaging opening 30 for engagement with said engaging wall 20*a*; and, (e) in said engagement, one end of said dog 16 is supported by said engaging wall 20*a* and the other end thereof is supported by the inner surface of said dog storage hole 15.

2. A recoil starter as set forth in claim 1, wherein there is provided a flat engaging surface in the leading end portion of said dog 16 and said engaging surface is engaged with said engaging wall 20*a*.

3. A recoil starter as set forth in claim 1, wherein pairs of engaging walls 20*a* are provided respectively at predetermined positions in said reel 9.

4. A recoil starter as set forth in claim 3, wherein the outer ends of said pair of engaging walls 20*a* are connected to each other to thereby form a substantially U-shaped configuration.

5. A recoil starter as set forth in claim 3, wherein said pairs of engaging walls 20*a* comprise parallel planes respectively.

6. A recoil starter as set forth in claim 1, wherein said crank pulley 29 is formed of synthetic resin.

7. A recoil starter as set forth in claim 1, wherein the portions of said reel 9 around said dog storage hole 15 is made thin.

8. A recoil starter as set forth in claim 1, wherein there is provided a bent portion 16*b* in the leading end portion of said dog 16, whereby said dog 16 is formed in a substantially L-shaped configuration.

9. A recoil starter as set forth in claim 1, wherein there is eliminated the need for hardening treatment on the surface of said dog 16.

10. A recoil starter as set forth in claim 1, wherein there is projectingly provided an annular wall 18 on said reel 9 disposed outside of said crank pulley 29 and said engaging wall 20*a* is connected to said annular wall 18.

* * * * *